US006257789B1

(12) United States Patent
Podszuweit et al.

(10) Patent No.: US 6,257,789 B1
(45) Date of Patent: Jul. 10, 2001

(54) WRITING INSTRUMENT

(75) Inventors: Dietmar Podszuweit, Hamburg; Thomas Reichert, Brande-Hornerkirchen, both of (DE)

(73) Assignee: Montblanc-Simplo GmbH, Hanburg (DE)

( * ) Notice: Subject to any disclaimer, the term of this patent is extended or adjusted under 35 U.S.C. 154(b) by 0 days.

(21) Appl. No.: 09/522,495

(22) Filed: Mar. 9, 2000

(30) Foreign Application Priority Data

Mar. 12, 1999 (DE) ..... 199 12 777

(51) Int. Cl.[7] ..... B43K 29/00

(52) U.S. Cl. ..... 401/195; 401/52; 401/192; 401/194; 401/202

(58) Field of Search ..... 401/195, 194, 401/52, 192, 202

(56) References Cited

U.S. PATENT DOCUMENTS

| | | | |
|---|---|---|---|
| 2,156,775 | 5/1939 | Zimmer . | |
| 3,876,315 | 4/1975 | Hain . | |
| 5,599,123 | 2/1997 | Still | 401/52 |
| 6,039,492 * | 3/2000 | Chen | 401/195 |
| 6,135,661 * | 10/2000 | Houser | 401/195 |

FOREIGN PATENT DOCUMENTS

| | | |
|---|---|---|
| 810251 | 8/1951 | (DE) . |
| 1006755 | 4/1957 | (DE) . |
| 37 05 456 A1 | 9/1988 | (DE) . |
| 296 03 835 U1 | 6/1996 | (DE) . |
| 0241 928 | 10/1987 | (EP) . |
| 08324517 | 5/1998 | (EP) . |
| 1157424 | 7/1969 | (GB) . |

* cited by examiner

*Primary Examiner*—Gregory L. Huson
*Assistant Examiner*—Tuan Nguyen
(74) *Attorney, Agent, or Firm*—Nixon & Vanderhye

(57) ABSTRACT

A writing instrument with elongated housing and a writing tip has an inscription or receiving area formed by an insertion panel. The insertion panel is set in a recess in the housing and operatively connected to a cover panel by a hinge extending with its pivot axis in the direction of elongation of the housing. In its closed position, the covering panel covers the insertion panel and is set with its outer surface essentially in alignment with the adjacent housing portions. When the covering panel is open, the inscription or receiving area is accessible.

21 Claims, 3 Drawing Sheets

WRITING INSTRUMENT

BACKGROUND AND SUMMARY OF THE INVENTION

The invention relates to a writing instrument with an elongated coverable inscription or receiving surface within a housing, and a writing tip. The inscription and receiving surface is substantially completely unobtrusive.

In a known writing instrument of this kind (DE 296 03 835), the inscription or receiving surface is formed by the circumferential area of a ring element connected to the cover cap of the writing instrument. The inscription surface may be covered by screwing a ring, preferably a metal ring, over the inscription surface. In its screwed on position the cover ring creates the impression of a conventional decorative ring on writing instruments so that it is not immediately recognizable that the ring is removable and that a written or writeable inscription surface is located beneath it.

With this known writing device, the form of the inscription surface is relatively small-scale and extends essentially in the direction of the circumference. Its function is limited to the inscription of a very short text produced conventionally by engraving, or of corresponding smaller representations.

It is also known (U.S. Pat. No. 2,156,775) to provide an inscription indentation in the covering cap of a writing instrument for the inscription of panel-formed items, showing individual letters or other pictorial illustrations, in which the panel-shaped or plate-like elements of ) elastic configuration are snapped into place. In this case, the use of specially designed panel-shaped elements is required, and only a few items such as letters, can be inserted. Moreover, the inserted symbols are always visible, while the inscription indentation provided is visible if no panel-shaped elements are inserted.

Furthermore, it is known to apply, on the shaft of the writing device (DE 810 251), or on its covering cap (DE 1 006 755), a cylindrically shaped illustration carrier, which if needed be can be enclosed in a transparent cylindrical body. In this case, a large illustration area is available, but one which is always visible.

According to the invention there is provided a writing instrument which may have a large inscription or receiving surface, but one which is not readily recognizable in normal use. That is according to the invention, the inscription or receiving surface is formed by an insertion panel which is inserted in a recess and is operatively connected to a covering panel by a hinge extending with its pivot axis in the direction of elongation of the housing so that the covering panel in its closed position covers the insertion panel and has its outer surface aligned with the adjacent housing area, and so that the inscription or receiving surface is accessible when the covering panel is open. Since the insertion panel and recess are preferably elongated in the dimension of elongation of the housing the inscription or receiving surface may be large, yet when the cover panel is closed substantially invisible.

The insertion panel and the covering panel may, for example, comprise or consist essentially of brass sheet, but it is appropriate if at least the outside surface of the covering panel consists essentially of a material of the same color, preferably of the same material, as the adjacent housing area, so that the presence of the covering panel is concealed when in the closed position.

According to one aspect of the present invention there is provided a writing instrument comprising: A housing elongated in a first dimension of elongation, and a writing tip. An elongated recess formed in the housing. An insertion panel having an inscription or receiving surface, the insertion panel positioned in the recess. An elongated cover plate dimensioned and shaped to cover the recess. And, a hinge which mounts the cover plate for pivotal movement about an axis substantially parallel to the first dimension for movement from a closed position in which the cover plate is substantially flush with the housing and covers the insertion panel, to an open position in which the insertion panel is exposed.

Preferably the cover panel has an outer surface of substantially the same color and material as portions of the housing adjacent the recess. Also preferably the hinge is so constructed and the cover panel is so constructed and has an outer surface so finished that when the cover panel is in the closed position the cover panel is substantially invisible. Desirably the housing adjacent the cover panel and the cover panel have substantially the same curvature about an axis parallel to the first dimension.

The insertion panel and cover panel are preferably of substantially the same size and shape, and the insertion panel may be adhesively or otherwise secured to the housing in the recess. Desirably the recess and cover panel are elongated in the first dimension and substantially rectangular.

The hinge may comprise at least one tubular hinge element affixed to the insertion panel or the housing at the recess, at least one tubular hinge element affixed to the cover panel, and a hinge pin extending through the tubular hinge elements. The implement may also have a notch formed in the housing at a portion of the recess opposite the hinge.

In the preferred embodiment the housing comprises a holding shaft with the writing tip extending axially outwardly therefrom, and a covering cap removably mounted on the holding shaft, and the recess is formed in the covering cap.

According to another aspect of the present invention there is provided a cover cap for a writing instrument comprising: An elongated housing having an open first end dimensioned so as to fit on a holding shaft of a writing instrument, the housing elongated in a first dimension. An elongated recess formed in the housing and elongated in the first dimension of elongation. An insertion panel having an inscription or receiving surface, the insertion panel positioned in the recess. An elongated cover plate, elongated in the first dimension and dimensioned and shaped to cover the recess. A hinge which mounts the cover plate for pivotal movement about an axis substantially parallel to the first dimension for movement from a closed position in which the cover plate is substantially flush with the housing and covers the insertion panel, to an open position in which the insertion panel is exposed. And, wherein the cover panel has an outer surface of substantially the same color and material as portions of the housing adjacent the recess, so that when the cover panel is in the closed position the cover panel is substantially invisible.

The invention is explained in more detail in the following with reference to the drawings showing on exemplary embodiment thereof.

DETAILED DESCRIPTION OF THE DRAWINGS

Figure 1:
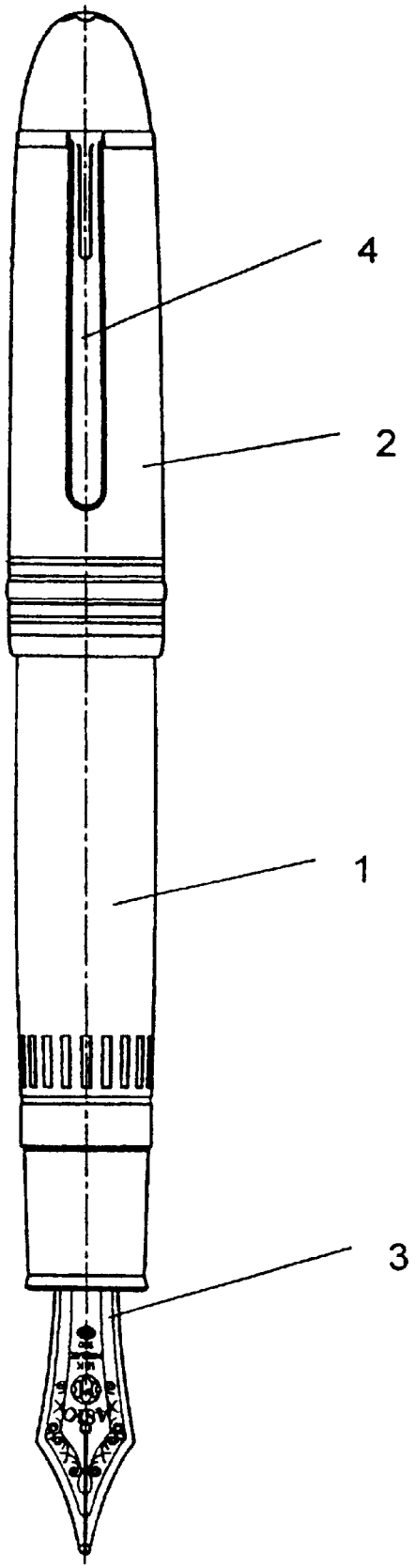
FIG. 1 is a side view of a writing instrument with a covering cap fitted on the back end of its holding shaft.

The illustrated writing instrument has a holder shaft 1, with a writing tip 3 in the form of a nib extending from its front end, i.e. the illustrated writing instrument is a conventional fountain-pen, whose internal structure will not be explained. Alternatively the writing instrument may be a cartridge pen, mechanical pencil, ball point pen, felt tip pen, or a like conventional implement. At the back end of the holder shaft 1 there is a cover cap 2, which optionally can also be placed on the front end, to cover the writing tip 3. The cover cap 2 may have a conventional clip 4.

In the wall of the cover cap 2, there is provided a recess 5 that is essentially rectangular, whose longer side edges run in the direction of elongation of the cover cap 2. The floor or bottom wall of the recess 5 is curved, substantially corresponding to the outer circumference of the adjacent areas of the cover cap 2. On the floor or bottom wall of the recess 5 there is affixed by adhesive a correspondingly curved, preferably metal, for instance brass, insertion panel 11, whose top surface 10 forms an inscription or receiving surface.

On a lengthwise edge of insertion panel 11, there is attached, for instance by laser spot welding, a tubular hinge central section 13, while to a cover panel 12 substantially correspondingly curved with the insertion panel 11 and having essentially the same dimensions as panel 11, two tubular hinge end pieces 14 are attached, again for example by spot welding, for instance, laser spot welding. Through these hinge pieces 13, 14, there extends a hinge pin 15 defining a pivot axis, so that the insertion panel 11 and the cover panel 12 are pivotally linked together via a hinge, and the cover panel 12 pivots with respect to the cap 2 about an axis substantially parallel to the dimension of elongation of the cap 2 from a closed position, where the panel 12 outer surface is substantially flush with the outer surface of the cap 2, to the open position illustrated in FIG. 2.

The cover panel 12, which may comprise or consist essentially of brass, is customarily coated with the material that was also used for the production of the wall of the cover cap 2. Thus, if the cover panel 12 is snapped shut from the open position as in FIG. 2 to the closed position, so that its curved inner surface lies essentially in surface contact on the inscription panel 10, the outer surface of the cover panel 12 not only is substantially in alignment (flush) with the other circumferential surface of the cover cap 2 in the area of the recess 5, but, as a result of the coating with the material of the adjacent wall of cover cap 2, the presence of cover panel 12 is substantially undetected.

Figure 2:
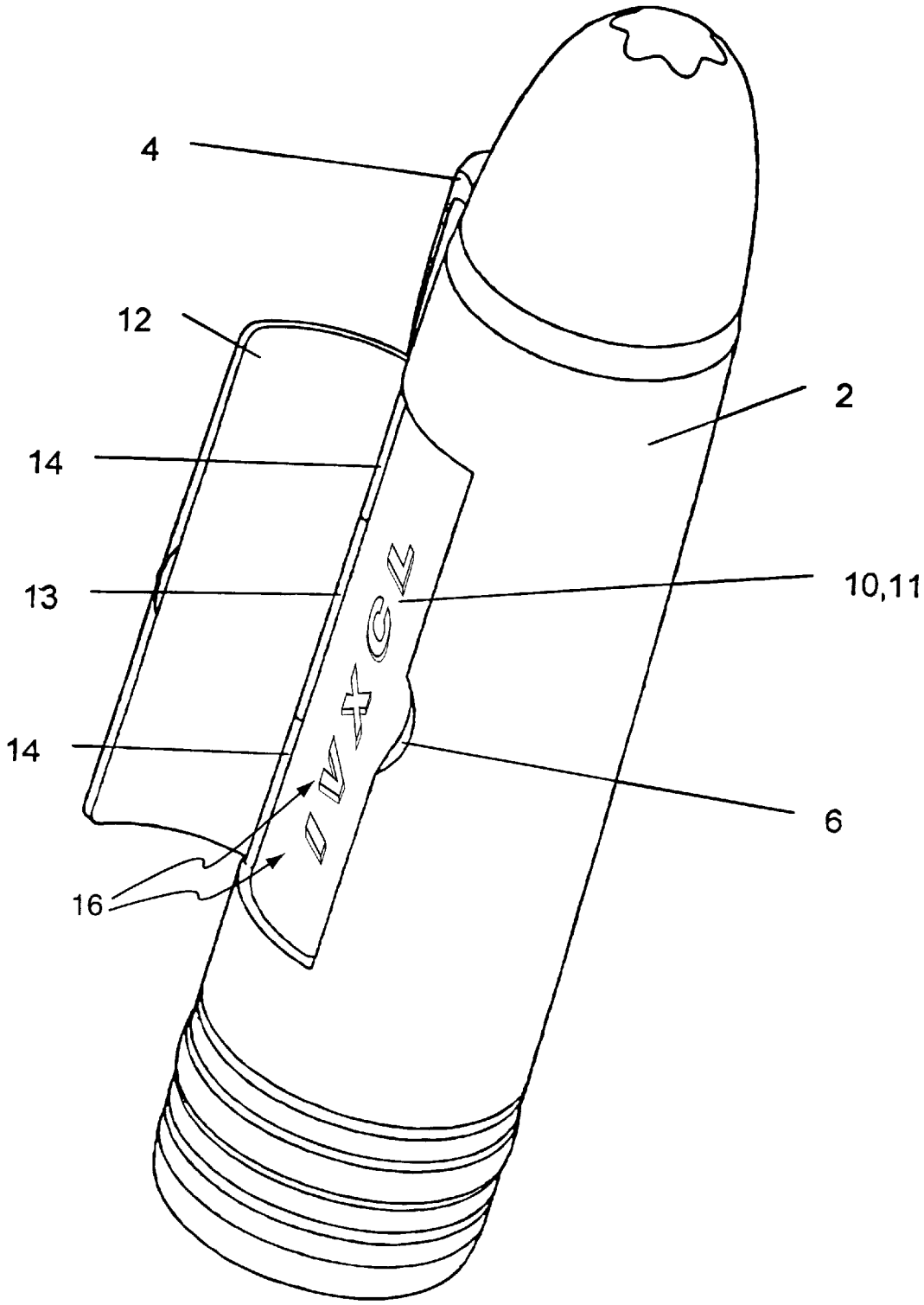
FIG. 2 is a perspective view of the cover cap of FIG. 1 with an open cover panel.
Figure 3:
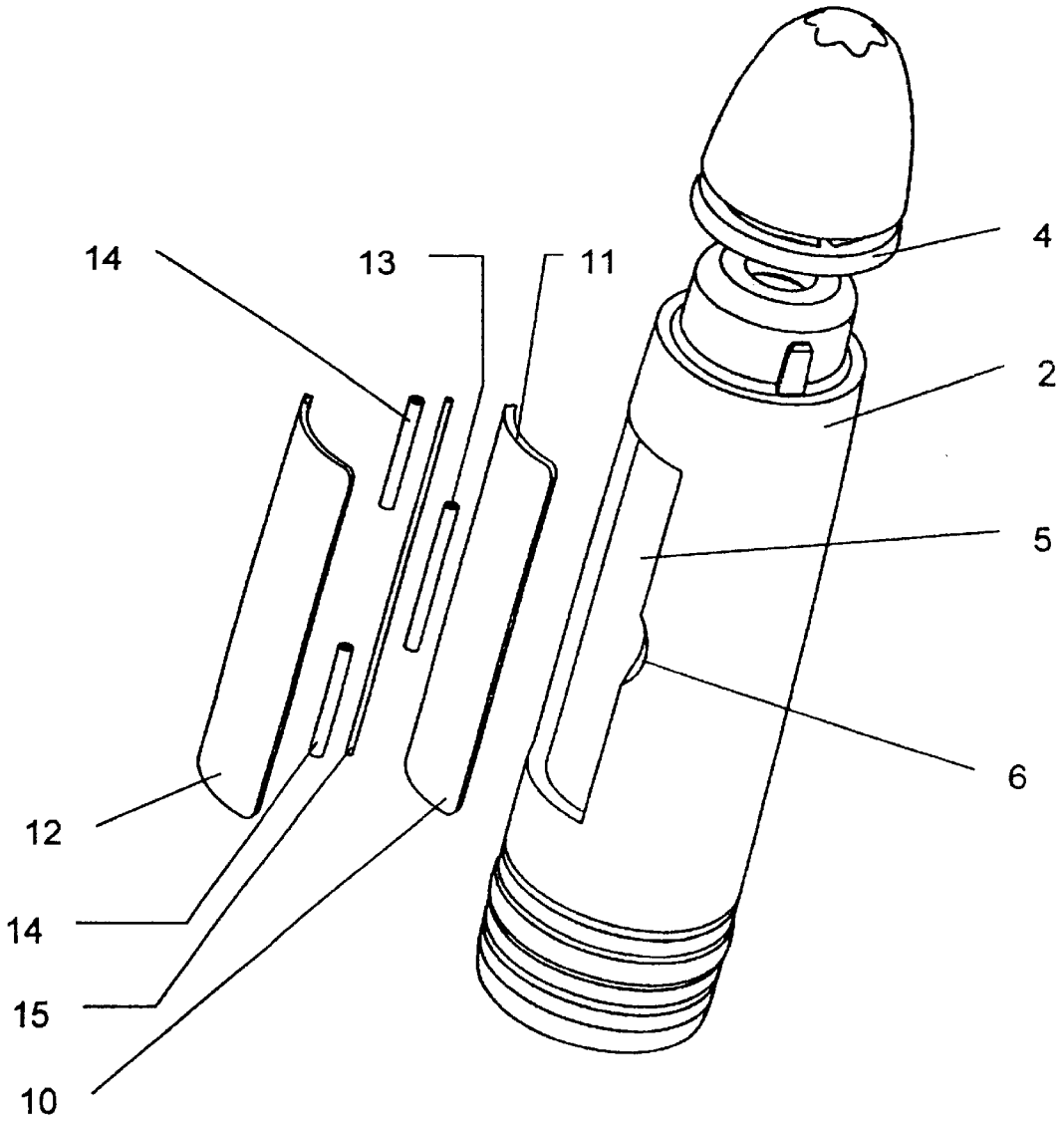
FIG. 3 is an exploded perspective view of the cap of FIG. 2.

In order to simplify opening of the cover panel 12 to facilitate its movement into the open position of FIG. 2, it is possible to provide on the side opposite the hinge arrangement 13, 14 at the edge of the recess 5 a notch 6. The notch 6 facilitates lifting of the edge of cover panel 12 to simplify opening of the cover panel 12.

As can be seen from FIG. 2, the inscription or receiving surface 10 of insertion panel 11 can be inscribed with writing or engraving, shown schematically at 16 in FIG. 2. It is also possible, to use the inscription or receiving surface 10 as a support surface for a thin-walled figure or data carrier.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A writing instrument comprising:

a housing elongated in a first dimension of elongation, and a writing tip;

an elongated recess formed in said housing;

an insertion panel having an inscription or receiving surface, said insertion panel positioned in said recess;

an elongated cover plate dimensioned and shaped to cover said recess; and a hinge which mounts said cover plate for pivotal movement about an axis substantially parallel to said first dimension for movement from a closed position in which said cover plate is substantially flush with said housing and covers said insertion panel, to an open position in which said insertion panel is exposed;

said hinge including a hinge element affixed to said insertion panel and a hinge element affixed to said cover plate, said hinge elements being cooperable with one another to enable said cover plate to move between said closed and open positions.

2. A writing instrument as recited in claim 1 wherein said cover plate has an outer surface; and wherein said outer surface is of the same color as adjacent portions of said housing.

3. A writing instrument as recited in claim 2 wherein said outer surface is of the same material as adjacent portions of said housing.

4. A writing instrument as recited in claim 3 wherein said recess and cover plate are elongated in said first dimension.

5. A writing instrument as recited in claim 4 wherein said recess and said cover plate are substantially rectangular.

6. A writing instrument as recited in claim 1 wherein said cover plate has an outer surface and wherein said outer surface is of the same material as adjacent portions of said housing.

7. A writing instrument as recited in claim 1 wherein said hinge and said cover plate are constructed and said cover plate has a finished outer surface such that, when said cover plate is in said closed position, said cover plate is substantially invisible.

8. A writing instrument as recited in claim 1 wherein said insertion panel is of substantially the same size and shape as said cover plate.

9. A writing instrument as recited in claim 1 wherein said housing adjacent said cover plate and said cover plate have substantially the same curvature about an axis parallel to said first dimension.

10. A writing instrument as recited in claim 1 wherein said insertion panel is adhesively secured to said housing.

11. A writing instrument as recited in claim 1 further comprising a notch formed in said housing at a portion of said recess opposite said hinge.

12. A writing instrument as recited in claim 1 wherein said recess and said cover plate are elongated in said first dimension.

13. A writing instrument as recited in claim 12 wherein said recess and said cover plate are substantially rectangular.

14. A writing instrument as recited in claim 1 wherein said hinge elements are tubular and said hinge includes a hinge pin extending through said tubular hinge elements.

15. A writing instrument as recited in claim 1 including a holding shaft with said writing tip extending axially outwardly therefrom, and a covering cap removably mounted on said holding shaft; and wherein said recess is formed in said covering cap.

16. A writing instrument as recited in claim 15 wherein said hinge and said cover plate are constructed and said cover plate has a finished outer surface such that when said cover plate is in said closed position said cover plate is substantially invisible.

17. A writing instrument as recited in claim 15 wherein said recess and cover plate are elongated in said first dimension.

18. A writing instrument as recited in claim 17 wherein said recess and said cover plate are substantially rectangular.

19. A writing instrument as recited in claim 18 wherein said cover plate has an outer surface of substantially the same color and material as portions of said housing adjacent said recess.

20. A cover cap for a writing instrument comprising:

an elongated housing having an open first end dimensioned so as to fit on a holding shaft of a writing instrument, said housing being elongated in a first dimension;

an elongated recess formed in said housing and elongated in said first dimension of elongation;

an insertion panel having an inscription or receiving surface, said insertion panel positioned in said recess;

an elongated cover plate, elongated in said first dimension and dimensioned and shaped to cover said recess and said insertion panel in said recess;

a hinge mounting said cover plate for pivotal movement about an axis substantially parallel to said first dimension for movement from a closed position in which said cover plate is substantially flush with said housing and covers said insertion panel, to an open position in which said insertion panel is exposed, said hinge including a first tubular hinge element affixed to said insertion panel and a second tubular hinge element affixed to said cover plate, and a hinge pin extending through said tubular hinge elements; and wherein said cover plate has an outer surface of substantially the same color and material as portions of said housing adjacent said recess, so that when said cover plate is in said closed position said cover plate is substantially invisible.

21. A cover cap according to claim 20 wherein said insertion panel is adhesively secured to said housing.

* * * * *